US010046554B1

(12) United States Patent
de Echaniz et al.

(10) Patent No.: US 10,046,554 B1
(45) Date of Patent: Aug. 14, 2018

(54) AUTOMATICALLY ADJUSTING NIP FORCE IN A PRINTING APPARATUS

(71) Applicant: Xerox Corporation, Norwalk, CT (US)

(72) Inventors: Sebastian Rodrigo de Echaniz, Milton Keynes (GB); Benjamin Thomas Thurnell, Sevenage (GB); Paul Simon Golding, Hertfordshire (GB); Michael John Wilsher, Letchworth Garden (GB)

(73) Assignee: Xerox Corporation, Norwalk, CT (US)

( * ) Notice: Subject to any disclaimer, the term of this patent is extended or adjusted under 35 U.S.C. 154(b) by 2 days.

(21) Appl. No.: 15/417,852

(22) Filed: Jan. 27, 2017

(51) Int. Cl.
*B41F 21/00* (2006.01)
*B41F 33/00* (2006.01)

(52) U.S. Cl.
CPC ..... *B41F 21/00* (2013.01); *B41F 33/00* (2013.01)

(58) Field of Classification Search
CPC ..... B41F 21/00
USPC ..... 101/407.1
See application file for complete search history.

(56) References Cited

U.S. PATENT DOCUMENTS 3,888,173 A * 6/1975 Ritzerfeld ..... B41F 31/00 101/352.08
4,020,788 A * 5/1977 Brooke ..... G03G 15/102 118/261
4,502,386 A * 3/1985 Cappel ..... B41F 31/04 101/352.09
8,538,310 B2 * 9/2013 Matsuda ..... G03G 15/1605 399/110
2002/0003332 A1 * 1/2002 Hiratani ..... B65H 1/12 271/121
2006/0086245 A1 * 4/2006 Pitkanen ..... D21G 1/002 92/1
2009/0262401 A1 * 10/2009 Sheng ..... H04N 1/121 358/474
2011/0200373 A1 * 8/2011 Fujii ..... G03G 15/6564 399/388
2013/0135698 A1 * 5/2013 Sumioka ..... H04N 1/00607 358/498
2014/0029996 A1 * 1/2014 Nozawa ..... G03G 21/203 399/388

* cited by examiner

*Primary Examiner* — Anthony Nguyen

(57) ABSTRACT

A feeding system in a printing apparatus is disclosed. For example, the feeding system includes a feed roll, a retard roll, a movable arm, a spring and a temperature dependent flexible material. The movable arm is coupled to the retard roll. The spring is coupled to the movable arm. The temperature dependent flexible material is located below the spring to move the retard roll towards the feed roll via the spring coupled to the end of the arm to maintain a nip force applied by the retard roll against the feed roll as a temperature in a location of the printing apparatus changes.

14 Claims, 3 Drawing Sheets

AUTOMATICALLY ADJUSTING NIP FORCE IN A PRINTING APPARATUS

The present disclosure relates generally to printing apparatuses and, more particularly, to a method and apparatus for automatically adjusting retard nip force to compensate for changes in the environment using a bimetallic strip.

BACKGROUND

Many printing apparatuses have a feed system that takes paper, or other types of print media, from a paper tray and feeds the paper to a printing portion of the printing apparatus. Properly feeding paper to the printing portion of the printing apparatus can improve operational efficiency of the printing apparatus, improve customer satisfaction of the printing apparatus, and the like.

Some feed systems can suffer from environmental changes where the printing apparatus is located. For example, changes in temperature and humidity may affect the performance of the feed system. For example, changes in temperature and humidity can cause the feed system to have a miss-feed or a multi-feed of the paper. As a result, these errors can negatively affect the operational efficiency of the printing apparatus, decrease customer satisfaction of the printing apparatus, and the like.

SUMMARY

According to aspects illustrated herein, there are provided a feeding system in a printing apparatus. One disclosed feature of the embodiments is a feeding system that comprises a feed roll, a retard roll, a movable arm coupled to the retard role, a spring coupled to the movable arm and a temperature dependent flexible material located below the spring to move the retard roll towards the feed roll via the spring coupled to the arm to maintain a nip force applied by the retard roll against the feed roll as a temperature in a location of the printing apparatus changes.

In one embodiment, the feeding system comprises a feed roll, a retard roll, an arm coupled to the retard role and a temperature dependent flexible material located below the arm to move the retard roll towards the feed roll via the arm to maintain a nip force applied by the retard roll against the feed roll as a temperature in a location of the printing apparatus changes.

In one embodiment, the feeding system comprises a feed roll, a retard roll, an arm coupled to the retard roll, a spring coupled to the arm, wherein spring moves the retard roll vertically via the arm to change a distance between the feed roll and the retard roll and a bimetallic strip, wherein an active side of the bimetallic strip is located below the spring, wherein the active side of the bimetallic strip moves against the spring towards the feed roll in response to changes in a temperature in a location of the printing apparatus to maintain a constant force applied by the retard roll towards the feed roll within a predefined range of force values as the distance between the feed roll and the retard roll is changed.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

The present disclosure broadly discloses a feeding system for a printing apparatus. As discussed above, many printing apparatuses have a feed system that takes paper, or other types of print media, from a paper tray and feeds the paper to a printing portion of the printing apparatus. Properly feeding paper to the printing portion of the printing apparatus can improve operational efficiency of the printing apparatus, improve customer satisfaction of the printing apparatus, and the like.

Some feed systems can suffer from environmental changes where the printing apparatus is located. For example, changes in temperature and humidity may affect the performance of the feed system. For example, changes in temperature and humidity can cause the feed system to have a miss-feed or a multi-feed of the paper. As a result, these errors can negatively affect the operational efficiency of the printing apparatus, decrease customer satisfaction of the printing apparatus, and the like.

Embodiments of the present disclosure provide a feeding system for a printing apparatus that can automatically make adjustments responsive to changes in the environment and apply a constant nip force to properly feed paper through the printing system. As a result, the feeding system of the present disclosure can avoid miss-feeds and multi-feeds even as environmental conditions (e.g., temperature, humidity level, and the like) of a location of the printing apparatus change.

Figure 1:
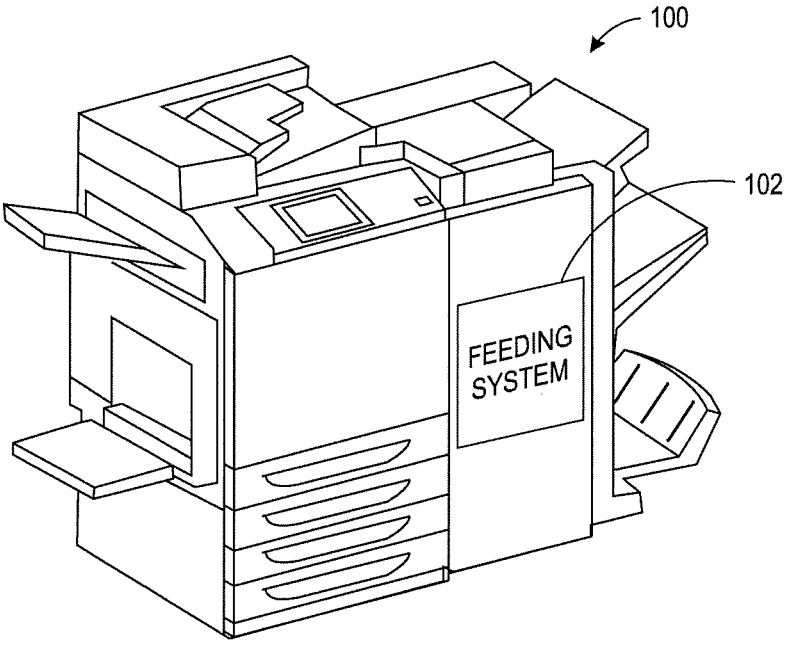
FIG. 1 illustrates an example printing apparatus with a feeding system of the present disclosure.

FIG. 1 illustrates an example printing apparatus 100 of the present disclosure. In one embodiment, the printing apparatus 100 may be an image forming device such as a multi-function device (MFD), a photocopier, a laser printer, an ink jet printer, and the like. The printing apparatus 100 of the present disclosure may be modified with a feeding system 102 of the present disclosure.

As described above, the printing apparatus 100 may be located in an environment that is not controlled. In other words, the environment may have fluctuations in temperature, humidity level and the like. For example, the environment may be an office building that does not have air conditioning or a temperature control device. As a result, changes in the environment may negatively impact the performance of the printing apparatus 100 using a traditional feeding system.

Figure 2:
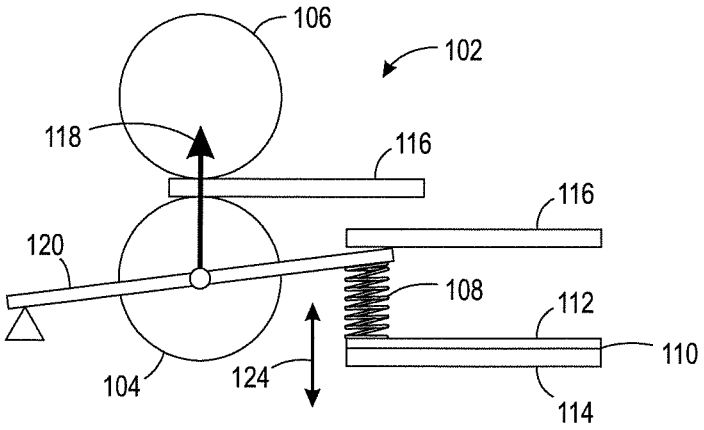
FIG. 2 illustrates an example block diagram of one embodiment of the feeding system of the present disclosure.

FIG. 2 illustrates an example block diagram of one embodiment the feeding system 102 that can automatically adjust to the changes in the environment (e.g., changes in temperature) to maintain a nip force. In one embodiment, the feeding system 102 may include a retard roll or retard pad 104, a feed roll 106, a movable arm 120, a spring 108 and a temperature dependent flexible material 110. It should be noted that the feeding system 102 has been simplified for ease of explanation and may include additional components that are not shown (e.g., mechanical fasteners, paper trays, coupling mechanisms, housings, support structures, electrical connections, and the like).

As noted above, the changes in the environment may impact how well the retard roll 104 and the feed roll 106 capture paper 116 to be fed to a printing portion of the printing apparatus 100. For example, at temperatures well below room temperature (e.g., 10-20 degrees Celsius (° C.) below room temperature of approximately 20-24° C.) the retard roll 104 and the feed roll 106 may lose frictional force that may result in a miss-feed (no paper 116 is fed). At temperatures well above (e.g., 10-20° C.) room temperature the retard roll 104 and the feed roll 106 may increase the frictional force that may result in a multi-feed (multiple sheets of paper 116 are fed).

In one embodiment, the miss-feed and the multi-feed may be caused by a change in a nip force (as shown by an arrow 118). For example, too little nip force caused by the lower temperatures can prevent the retard roll 104 and the feed roll 106 from grabbing the paper 116. Similarly, too much nip force caused by the higher temperatures can cause the retard roll 104 and the feed roll 106 to grab more than one sheet of paper 116.

In one embodiment, the feeding system 102 may be designed to automatically maintain a nip force despite changes in the environment. In one embodiment, the nip force may be maintained within a predefined range or an acceptable operating tolerance of nip force. In other words, in some examples, "maintain" may be defined to allow the nip force to change or be modified within a predefined range of nip force values. The predefined range may be a function of the design of the feeding system 102. For example, different materials used for the retard roll 104, the feed roll 106, the movable arm 120, the spring 108 and the paper 116 may be affected by changes in the environment or temperature differently.

In one embodiment, the feeding system 102 may include the temperature dependent flexible material 110. In one embodiment, the temperature dependent flexible material 110 may include an active layer 112 and a passive layer 114. The active layer 112 and the passive layer 114 may have different amounts of mechanical displacement in different temperature ranges. In addition, the active layer 112 and the passive layer 114 may have different directions of mechanical displacement in the different temperature ranges.

For example, at colder temperatures the active layer 112 may bend upwards or towards the feed roll 106 to compensate for a loss of nip force. The active layer 112 may bend in an opposite direction back into a neutral position (e.g., away from the feed roll 106) as the temperature rises back to a normal room temperature to compensate for an increase in nip force. Notably, the feed system 102 is maintaining a nip force and not a constant distance between the retard roll 104 and the feed roll 106. In other words, the distance between a surface of the retard roll 104 and the feed roll 106 may change in order to maintain the nip force applied by the retard roll 104 against the feed roll 106.

In one embodiment, the temperature dependent flexible material 110 may be a bimetallic strip. For example, the active layer 112 and the passive layer 114 may be fabricated from two different types of metals or metal alloys that have different coefficients of thermal expansion. As a result, the active layer 112 and the passive layer 114 may have different mechanical displacements at different temperature ranges. Examples of the metal or metal alloys that can be used may include nickel, iron, manganese, chrome, or different combinations of the metals to form alloys thereof, in different amounts.

In one embodiment, the metals or metal alloys used may be a function of an amount of movement or mechanical displacement that is needed to maintain a nip force for a particular temperature range of the environment that the printing apparatus 100 may be located. In one embodiment, the dimensions of the temperature dependent flexible material 110 may also be a function of the amount of movement or mechanical displacement that is needed to maintain a nip force for a particular temperature range of the environment that the printing apparatus 100 may be located. For example, the dimensions (e.g., a length, a width, and a thickness) of the temperature dependent flexible material 110 may be determined based on a type of materials that are used for the active layer 112 and the passive layer 114 and a series of equations.

For example, a change in spring force may be defined by Equation (1) below:

$$(F-F_0)=kA, \qquad \text{Equation (1):}$$

where $F-F_0$ represents a change in the nip force, k is a spring constant of the spring 108 and A is an amount of deflection of the temperature dependent flexible material 110.

The amount of deflection, A, and the chance in the nip force $F-F_0$ may also be represented by Equations (2) and (3) as shown below:

$$A = \frac{a(T-T_0)L^2}{s}, \qquad \text{Equation (2)}$$

$$F - F_0 = \frac{aE(T-T_0)bs^2}{4L}, \qquad \text{Equation (3)}$$

where L is a length of the temperature dependent flexible material 110, b is a width of the temperature dependent flexible material 110, s is a thickness of the temperature dependent flexible material 110, $T-T_0$ is a temperature change in the environment, a is the specific deflection of the active layer 112 and E is the modulus of elasticity of the active layer 112.

Figure 4:
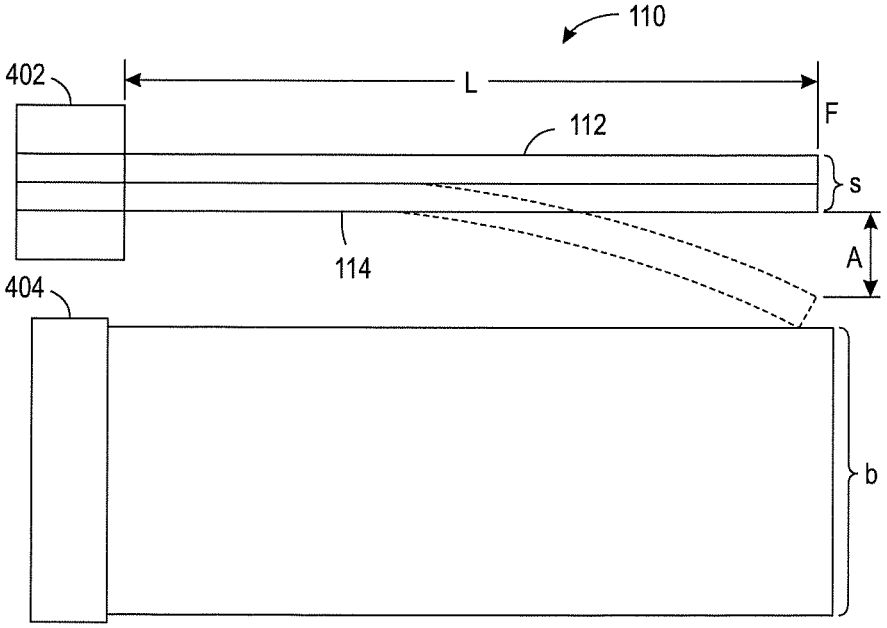
FIG. 4 illustrates an example block diagram of defining parameters of the present disclosure.

FIG. 4 illustrates a block diagram illustrating a side view 402 and a top view 404 of the temperature dependent flexible material 110 that define the parameters described in Equations (1)-(3). The temperature dependent flexible material 110 may see a change in nip force while deflecting, due to the spring 108 being compressed. Thus, the relationship between the change in temperature, the change in nip force and the deflection may be represented by Equation (4) below:

$$A = \frac{a(T-T_0)L^2}{s} - \frac{4(F-F_0)L^3}{Ebs^3} = \frac{(F-F_0)}{k}, \qquad \text{Equation (4)}$$

solving for the change in nip force $F-F_0$ may yield Equation (5) below:

$$(F-F_0) = \frac{aL^2(T-T_0)}{s\left(\frac{1}{k} + \frac{4L^3}{bs^3E}\right)} \qquad \text{Equation (5)}$$

As can be seen by Equation (5), the dimensions (e.g., the length L, the thickness s and the width b) of the temperature dependent flexible material 110 may be tuned based on the desired amount of nip force to be maintained or modified at a given temperature change $T-T_0$ given the properties of the spring 108 and the materials used for the active layer 112.

To illustrate one numerical example, the amount of nip force required in a printing system may be 3.2 newtons (N). However, in cold environments the amount of nip force may be 2.9 N for a difference of 0.3 N. Using Equation (5) above with a temperature difference of 15° C. using a spring that has a spring constant k=0.283, a material for the active layer 112 that has a modulus of elasticity E=135,000 N per square millimeter ($N/mm^2$), the parameters may be tuned to use a temperature dependent flexible material 110 having a length of 50 mm, a thickness of 0.5 mm and a width of 12 mm to achieve a 1 mm deflection to obtain the difference of force of 0.28 N (approximately the 0.3 N).

In one embodiment, the retard roll 104 may be coupled to the movable arm 120. In one embodiment, approximately a center of the movable arm 120 may be coupled to the retard roll 104 via any mechanical fastener (e.g., a screw, pin, bolt, and the like). The movable arm 120 may move the retard roll 104 along a vertical axis as shown by the arrow 124. In other words, the movable arm 120 may move the retard roll 104 closer to or farther away from the feed roll 106.

One end of the movable arm 120 may be coupled to the spring 108. The temperature dependent flexible material 110 may be located below the spring 108. For example, a portion, one end, or an edge, of the temperature dependent flexible material 110 may be located below the spring 108. In one embodiment, the active layer 112 may be adjacent to the spring 108. In another embodiment, the passive layer 114 may be adjacent to the spring 108.

As described above, as the temperature in the location of the printing apparatus 100 changes, the temperature dependent flexible material 110 may move, bend or be mechanically displaced in accordance with the Equations (1)-(5) described above. The combination of the temperature dependent flexible material 110 and the spring 108 may move the retard roll 104 to maintain a nip force against the feed roll 106 as the temperature in the location of the printing apparatus 100 changes.

As a result, the feeding system 102 may automatically adjust to the changes in the environment (e.g., temperature changes) of the printing apparatus 100. The automatic adjustments may be implemented by the temperature dependent flexible material 110 to move the retard roll 104 via the spring 108 to maintain a force against the feed roll 106. As a result, even as the environment changes, the likelihood of a miss-feed or a multi-feed may be reduced significantly.

Figure 3:
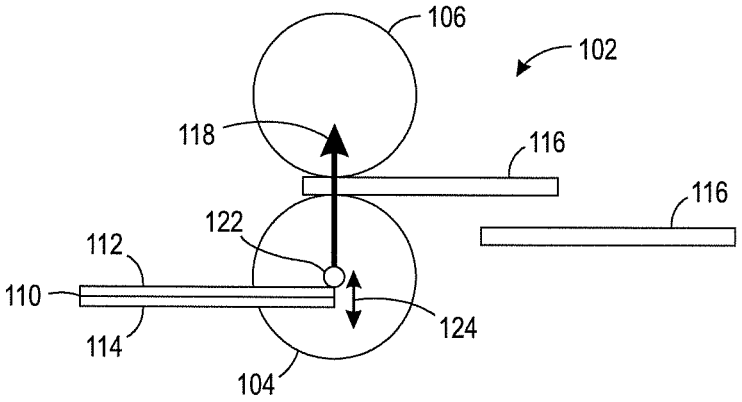
FIG. 3 illustrates an example block diagram of another embodiment of the feeding system of the present disclosure.

FIG. 3 illustrates an example block diagram of another embodiment of the feeding system 102. In one embodiment, the feeding system 102 may include the retard roll 104, the feed roll 106 and the temperature dependent flexible material 110 similar to the embodiment illustrated in FIG. 2. For example, the temperature dependent flexible material 110 may also be a bimetallic strip as described above. In addition, the dimensions of the temperature dependent flexible material 110 may depend on the parameters associated with a material of the active layer 112, a spring constant and the change in the amount of nip force for a change in temperature as described by Equation (5) above.

The feeding system in the embodiment illustrated in FIG. 3, however, may include an arm 122 coupled to the retard roll 104. The arm 122 may include a physical member that extends out of the page from the center of the retard roll 104. For example, an axis or rod that the retard roll 104 rolls around on can be extended beyond a width of the retard roll 104 (e.g., coming out of the page in FIG. 3). The temperature dependent flexible material 110 may be located below the arm 122. As the temperature changes, the temperature dependent flexible material 110 may bend and directly contact the arm 122. As the arm moves in a direction up and down along a vertical axis illustrated by the arrow 124, the arm may also move the retard roll 104 closer to or farther away from the feed roll 106. As a result a constant nip force may be applied by the retard roll 104 as the temperature changes in the location of the printing apparatus 100.

It should be noted that the embodiments illustrated in FIGS. 2 and 3 are examples of a variety of different configurations using the temperature dependent flexible material 110 that can be deployed. For example, the temperature dependent flexible material 110 may be positioned against the arm 122 in FIG. 3 to wrap around the arm 122 and pull the retard roll 104 down as the temperature dependent flexible material 110 coils around as the temperature changes. Thus, the particular configurations illustrated in FIGS. 2 and 3 should not be considered limiting.

Figure 5:
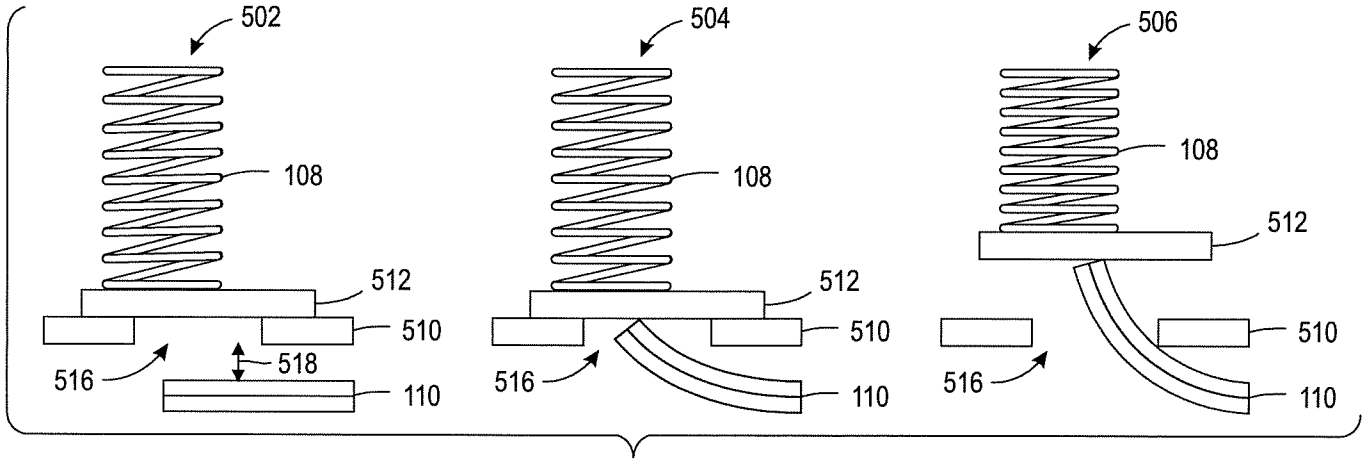
FIG. 5 illustrates an example block diagram of a system of the present disclosure to limit activation of the temperature dependent flexible material to a pre-defined temperature change threshold.

In one embodiment, the feeding system 102 may include an example system 500 illustrated in FIG. 5 to limit activation of the temperature dependent flexible material 110 to a pre-defined temperature change threshold. In some applications it may be desirable to control the temperature at which the temperature dependent flexible material 110 may be activated.

In one embodiment, the system 500 may include a movable plate 512 located below the spring 108. The movable plate 512 may be in contact with the spring 108 or coupled to the spring 108. The spring 108 may be coupled to the movable arm 120 as illustrated in FIG. 2. It should be noted that the spring 108 may be optional. As described above in FIG. 3, some embodiments may not include the spring 108. As a result, the movable plate 512 may also be located below the arm 122.

In one embodiment, the system 500 may also include a fixed plate 510. The fixed plate 510 may be positioned below the movable plate 512 and above the temperature dependent flexible material 110.

In one embodiment, the fixed plate 510 may comprise two parallel plates that are spaced apart or a single fixed plate with an opening 516. For example, the opening 516 may allow the temperature dependent flexible material 110 to move through the opening 516 and contact the movable plate 512. As a result, the temperature dependent flexible material 110 may move the movable plate 512 upward, thereby, pushing against the spring 108. As the temperature dependent flexible material 110 falls back to a neutral position, the movable plate 512 may also fall, thereby, allowing the spring 108 to also fall back to a neutral position. In one embodiment, "neutral position" may be defined to be a position where the temperature dependent flexible material 110 has zero mechanical displacement or a return position of the spring 108.

In view 502, the temperature dependent flexible material 110 may be in a neutral position at room temperature. In one embodiment, a distance 518 between the fixed plate 510 and the temperature dependent flexible material in the neutral position may be a function of the pre-defined temperature change threshold and an amount of mechanical displacement of the temperature dependent flexible material 110 at the pre-defined temperature change threshold.

For example, for a particular application, it may be desirable to only activate the temperature dependent flexible material when the temperature change is greater than 20° C. (e.g., the pre-defined temperature change threshold may be 20° C.). Thus, the amount of displacement for given dimensions of a temperature dependent flexible material 110 at a temperature change of 20° C. may be calculated using Equation (2) above. The distance 518 may then be set based on the calculated displacement at the pre-defined temperature change threshold.

Using the above example, view 504 illustrates the temperature dependent flexible material 110 at a temperature change of greater than 0° C. to less than 20° C. The temperature dependent flexible material 110 has moved or been mechanically displaced, but has not moved enough to move the movable plate 512. In other words, the movable plate 512 remains resting against the fixed plate 510.

View 506 illustrates the temperature dependent flexible material 110 at a temperature change of greater than 20° C. For example, the mechanical displacement of the temperature dependent flexible material 110 is greater than the displacement calculated for a temperature change of 20° C. calculated by using Equation (2) above. As a result, the mechanical displacement of the temperature dependent flexible material 110 now pushes against the movable plate 512 to move the movable plate 512 and compresses the spring 108. As the temperature change falls back below 20° C., the temperature dependent flexible material 110 may move back towards the neutral position in view 502 allowing the movable plate 512 to fall back against the fixed plate 510.

It should be noted that the numerical values used in the examples above should not be considered limiting. For example, the distance 518 may be set for any desired pre-defined temperature change threshold for any particular application.

In one embodiment, the fixed plate 510 may be coupled to another portion of the feeding system 102. For example, the fixed plate 510 may be coupled to a bracket, housing, structure, wall, and the like (not shown), of the feeding system 102. In one embodiment, the fixed plate 510 may be welded onto or molded as part of another structure within the feeding system 102. In one embodiment, the fixed plate 510 may be mechanically fastened to another structure within the feeding system 102.

In one embodiment, the movable plate 512 may be coupled to the spring 108, as noted above. In another embodiment, the movable plate 512 may be coupled to a guide rail or other mechanical means to secure the movable plate 512 against the spring 108, while allowing movement in a desired direction (e.g. vertically up and down).

Thus, the embodiments of the present disclosure provide a feeding system 102 for a printing apparatus 100 that maintains a nip force during changes in the environment of the printing apparatus 100. For example, a nip force may be maintained during temperature changes in a location of the printing apparatus 100. As a result, the number of miss-feeds and multi-feeds may be significantly reduced even as the temperature changes in an uncontrolled environment.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A feeding system in a printing apparatus, comprising:
- a feed roll;
- a retard roll;
- a movable arm coupled to the retard role;
- a spring coupled to the movable arm;
- a temperature dependent flexible material located below the spring to move the retard roll towards the feed roll via the spring coupled to the movable arm to maintain a nip force applied by the retard roll against the feed roll as a temperature in a location of the printing apparatus changes; and
- a system to limit activation of the temperature dependent flexible material to a pre-defined temperature change threshold, wherein the system comprises:
  - a movable plate located below the spring; and
  - a fixed plate positioned below the movable plate and above the temperature dependent flexible material.

2. The feeding system of claim 1, wherein the temperature dependent flexible material comprises a bimetallic strip.

3. The feeding system of claim 1, wherein dimensions of the temperature dependent flexible material are a function of an amount of the nip force that is maintained, a change in temperature, a specific deflection value of the temperature dependent flexible material and a modulus of elasticity of the temperature dependent flexible material.

4. The feeding system of claim 3, wherein the dimensions comprise a length, a width and a thickness of the temperature dependent flexible material.

5. The feeding system of claim 1, wherein the fixed plate comprises an opening to allow the temperature dependent flexible material to contact the movable plate.

6. The feeding system of claim 5, wherein a distance between the fixed plate and the temperature dependent flexible material in a neutral position is a function of the pre-defined temperature change threshold and an amount of mechanical displacement of the temperature dependent flexible material at the pre-defined temperature change threshold.

7. The feeding system of claim 5, wherein the nip force is maintained within a predefined range of nip values.

8. A feeding system in a printing apparatus, comprising:
- a feed roll;
- a retard roll;
- an arm coupled to the retard roll;
- a temperature dependent flexible material located below the arm to move the retard roll towards the feed roll via the arm to maintain a nip force applied by the retard roll against the feed roll as a temperature in a location of the printing apparatus changes; and
- a system to limit activation of the temperature dependent flexible material to a pre-defined temperature change threshold, wherein the system comprises:
  - a movable plate located below the arm; and
  - a fixed plate positioned below the movable plate and above the temperature dependent flexible material.

9. The feeding system of claim 8, wherein the temperature dependent flexible material comprises a bimetallic strip.

10. The feeding system of claim 8, wherein dimensions of the temperature dependent flexible material are a function of an amount of the nip force that is maintained, a change in temperature, a specific deflection value of the temperature dependent flexible material and a modulus of elasticity of the temperature dependent flexible material.

11. The feeding system of claim 10, wherein the dimensions comprise a length, a width and a thickness of the temperature dependent flexible material.

12. The feeding system of claim 8, wherein the fixed plate comprises an opening to allow the temperature dependent flexible material to contact the movable plate.

13. The feeding system of claim 12, wherein a distance between the fixed plate and the temperature dependent flexible material in a neutral position is a function of the pre-defined temperature change threshold and an amount of mechanical displacement of the temperature dependent flexible material at the pre-defined temperature change threshold.

14. A feeding system in a printing apparatus, comprising:

a feed roll;

a retard roll;

an arm coupled to the retard roll;

a spring coupled to the arm, wherein spring moves the retard roll vertically via the arm to change a distance between the feed roll and the retard roll;

a bimetallic strip, wherein an active side of the bimetallic strip is located below the spring, wherein the active side of the bimetallic strip moves against the spring towards the feed roll in response to a change in a temperature in a location of the printing apparatus to maintain a force applied by the retard roll towards the feed roll within a predefined range of force values as the distance between the feed roll and the retard roll is changed; and a system to limit activation of the temperature dependent flexible material to a pre-defined temperature change threshold, wherein the system comprises:

a movable plate located below the spring; and a fixed plate positioned below the movable plate and above the temperature dependent flexible material, wherein a distance between the fixed plate and the temperature dependent flexible material in a neutral position is a function of the pre-defined temperature change threshold and an amount of mechanical displacement of the temperature dependent flexible material at the pre-defined temperature change threshold.

* * * * *